US005369380A

United States Patent [19]

Ball et al.

[11] Patent Number: 5,369,380

[45] Date of Patent: Nov. 29, 1994

[54] MICROWAVE CONNECTOR

[75] Inventors: Gregory J. Ball; Michael Dean; Andrew L. Hume, all of Worcester, United Kingdom

[73] Assignee: The Secretary of State of Defence in Her Majesty's Government of the United Kingdom of Great Britain and Northern Ireland of Defence Research Agency, United Kingdom

[21] Appl. No.: 50,361

[22] PCT Filed: Dec. 19, 1991

[86] PCT No.: PCT/GB91/02271

§ 371 Date: May 14, 1993

§ 102(e) Date: May 14, 1993

[87] PCT Pub. No.: WO92/12547

PCT Pub. Date: Jul. 23, 1992

[30] Foreign Application Priority Data

Jan. 4, 1991 [GB] United Kingdom ..... 9100173

[51] Int. Cl.[5] ..... H01P 5/08

[52] U.S. Cl. ..... 333/128; 333/26; 333/33; 333/260

[58] Field of Search ..... 333/26, 33–35, 333/246, 260, 128

[56] References Cited

U.S. PATENT DOCUMENTS 3,573,670 4/1971 Skobern ..... 333/33

FOREIGN PATENT DOCUMENTS 0283396 9/1988 European Pat. Off. .

75002 5/1982 Japan ..... 333/26

277004 11/1989 Japan ..... 333/26

OTHER PUBLICATIONS

Patent Abstracts of Japan, vol. 14, No. 511, (E-99) Nov. 1990 & JP,A,2 213 201 (Fujitsu Ltd.) 24 Aug. 1990.

IEEE Transactions on Microwave Theory and Techniques, vol. 37, No. 3, Mar. 1989, New York US pp. 519–525, J. J. Burke et al.

IEEE Transactions on Microwave Theory and Techniques, vol. 36, No. 8, Aug. 1988, New York US pp. 1272–1282; B. Schuppert: 'Microstrip/ et al.

*Primary Examiner*—Paul Gensler

*Attorney, Agent, or Firm*—Nixon & Vanderhye

[57] ABSTRACT

A microwave connector comprises two substrates arranged in orthogonal planes. A first substrate (2) is formed as a microstrip system (8) with a microstrip component (3) connected via a quarter wavelength taper (4) to a parallel transmission line (5). This transmission line terminates in a short circuit (15) to a ground electrode (7) on the back of the microstrip. A second substrate (10) is formed as a slotline system (9) having a slotline (13) between two sheet electrodes (14). In this slotline is a slot (16) of dimensions slightly less than the slotline width and sufficient length to accommodate the microstrip. The microstrip and slotline are electrically unconnected. Energy transfer between microstrip and slotline, or vice versa, takes place by electromagnetic coupling between the transmission line and the edges of the slotline. The slotline may be formed with an additional substrate and slotline electrode in a triplate configuration. Several microstrip components ($8_1$ to $8_n$) may be connected in a single slotline substrate (10, 13).

5 Claims, 4 Drawing Sheets

MICROWAVE CONNECTOR

BACKGROUND OF THE INVENTION

1. Field of the Invention This invention relates to a microwave connector for connecting microwave energy between two substrates in orthogonal or near-orthogonal planes that are not electrically connected.

2. Discussion of Prior Art

Such a connector finds use for example in phased array radar systems where a large number of antenna modules must be driven from a single local oscillator with equal or near equal amplitude and phase. This is achieved by successive dividers. If the divider network is manufactured from stripline (triplate) or microstrip, it is necessary to use surface launch, right angle, connectors from the stripline to each of the modules. This is expensive, time consuming, and at times difficult to implement.

Microstrip circuits are a known type of device. They comprise a flat plate-like insulating substrate carrying conducting tracks on one surface with a ground electrode covering the opposite face. The conducting track can be shaped into many standard forms to give couplers, circulators, dividers, etc. Slotline circuits are a known type of device. They comprise a plate-like insulating substrate covered on one surface with a sheet electrode that is selectively removed to provide a narrow slot of exposed substrate; it is similar to but the inverse of microstrip. A variation on microstrip is triplate which is effectively two microstrip circuits glued face to face. Triplate comprises two insulating substrates face to face with a conducting strip circuit between them. The reverse faces carry sheet ground electrodes. Known microwave connectors include simple surface launch connectors. These need to be firmly fixed onto the stripline substrate, requiring the use of screws or bolts, and so can be an expensive construction method in production. This structure is very rigid and allows no stress relief. Another known connector uses a customized surface launch connector as described in Microwaves and RF, August, 1989, pages 137–143, S. S. Horwitz and G. W. Bull. It employs a pin connection requiring a connecting pin and welding of a gold ribbon from the stripline track to the pin. The connector has a horseshoe shaped body that passes through a shaped aperture in the stripline track and is fixed by a single nut. Both of these connectors output the microwave signal in a coaxial line, requiring the use of another connector if the signal is to be launched into microstrip. They can also require a large amount of expensive metal work.

SUMMARY OF THE INVENTION

The connector of the present invention provides a simple microwave connector not requiring electrical connection, and is insensitive, in amplitude and phase to vibration and strain.

According to this invention a microwave connector comprises a first substrate and a second substrate arranged with the first substrate within an aperture in the second substrate in substantially orthogonal, or within 45° of being orthogonal, planes; the first substrate being a microstrip circuit including a taper section leading from a microstrip component to a pseudo parallel plate transmission line having a length of approximately half wavelength long terminating in a short circuit to the ground plane; the second substrate being a slotline circuit having a slotline component terminating in a short circuit element, and a slot aperture adjacent to the short circuit element of length approximately half the slotline wavelength long sufficient to accommodate the first substrate pseudo parallel plate transmission line and width less than the slotline width; the arrangement being such that the two substrates are electrically unconnected and that energy transfer occurs between the two substrates due to electromagnetic coupling between the parallel plate transmission line and the slotline.

The two substrates preferably lie in orthogonal planes but may be up to plus or minus 45° from this condition with consequential loss in performance.

The second substrate may further include a conventional slotline to microstrip or triplate transition so that the whole microwave connector may be inserted into a microstrip system. The second substrate may further include a second slotline component on its reverse face to form a triplate structure around the conventional slotline to microwave transition.

The relative sizes of the first substrate and the slot aperture may be arranged so that the two substrates are held together with a slight interference fit, i.e. the two substrates can be readily assembled and separated but are self supporting.

BRIEF DESCRIPTION OF THE DRAWING

The invention will now be described by way of example only with reference to the accompanying drawings of which.

DETAILED DISCUSSION OF PREFERRED EMBODIMENTS

Figure 1:
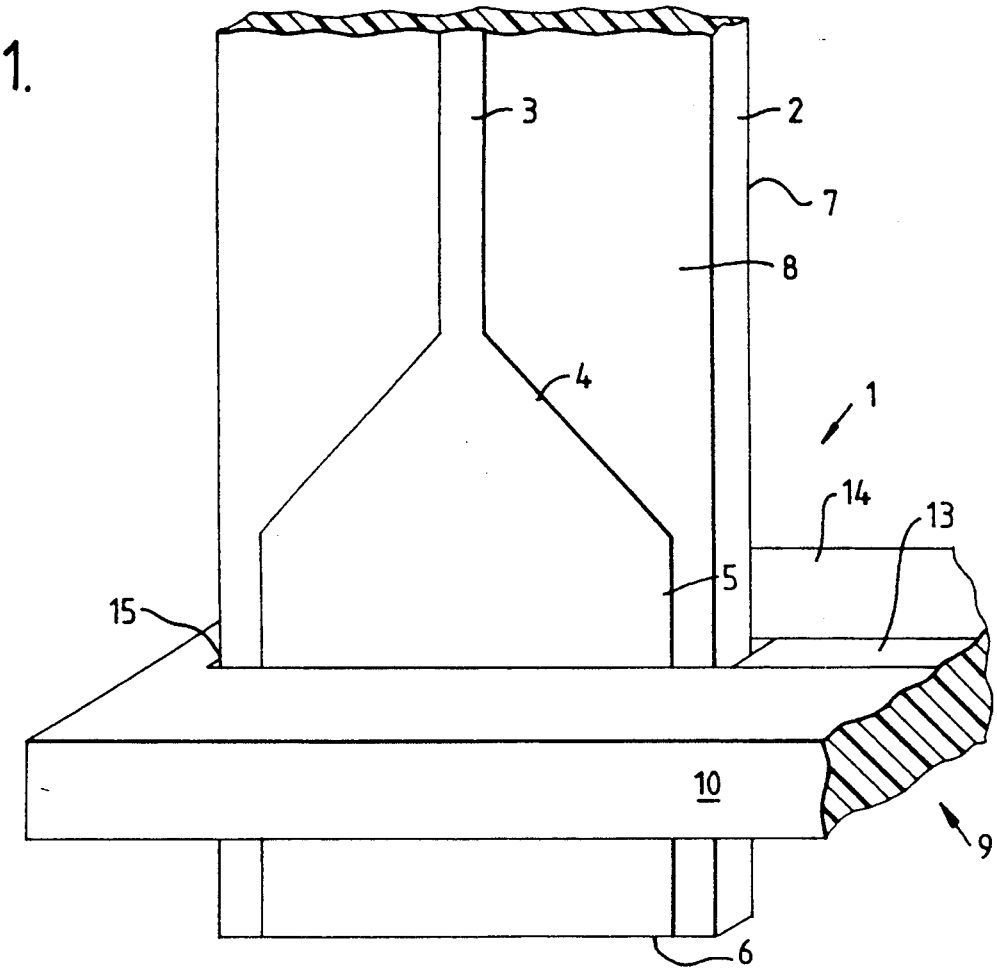
FIG. 1 is a perspective view of the connector.
Figure 2:
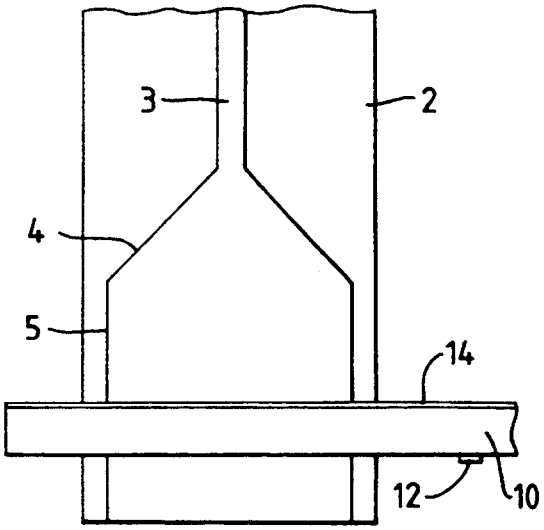
FIG. 2 is a front view of FIG. 1.
Figure 3:
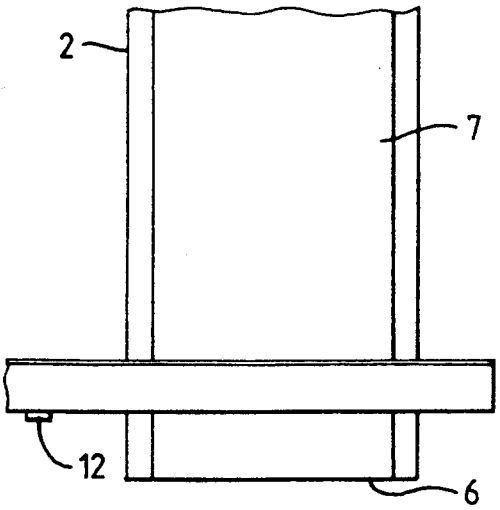
FIG. 3 is a rear view of FIG. 1.
Figure 4:
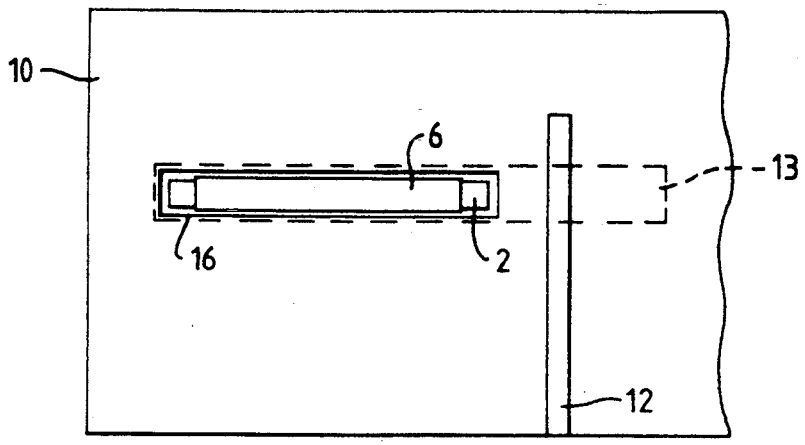
FIG. 4 is a plan view of FIG. 1.

As shown in the figures a microwave connector 1 comprises a first substrate 2 carrying a microstrip component 3 connecting to a quarter wavelength taper section 4 and a pseudo parallel plate transmission line 5. The length of the transmission line is about one half wavelength and terminates in a wrap around short circuit 6 to a ground sheet electrode 7 on the rear face of the substrate 2.

Typically the substrate 2 is a ceramic in plastic matrix material plate 0.71 mm thick, 7 mm wide, with a dielectric constant between 2.5 to 10. For example the substrate 2 may be RT/Duroid (Registered Trade Mark). The microstrip is an 18 um thick shaped layer of gold or copper etched out onto the substrate 2. Operating frequency is about 8.5 GHz so that length of the taper 4 is about 2.8 mm, the length of the transmission line 5 is about 5.8 mm, and the width of the transmission line 5 about 5.25 mm. The substrate 2 with microstrip components 3 etc forms a microstrip line 8.

A slotline system 9 comprises a second substrate 10 and carries a slotline circuit on its upper face. The slotline is formed by a slot 13 in a sheet electrode 14. Both ends of the slotline terminate in a slotline short circuit 15. Adjacent short circuit 15 is a slot 16 through the thickness of the substrate 10. Spaced from the other end of the slot 16 is a microstrip line 12 arranged on the bottom of the substrate 10 to form a conventional transmission feed. The gap between feed 12 and the adjacent end of slot 13 is about a quarter slotline wavelength; the distance between the free end of the feed 12 and centre of slot line 13 is about a quarter stripline wavelength. The first substrate 2 fits into this slot with a slight interference, or sliding, fit sufficient to enable easy assembly and remain self supporting. Small changes in the dimensions of the slot 16 do not seem to affect the performance of the transition. The first substrate may be inserted into the slot 16 in any one of the four possible orientations.

typically the substrate 10 is an RT/Duroid (TM) plate, 1.26 mm thick, and any convenient width with a dielectric constant between 2.5 and 10. The electrodes 14 are 18 μm thick layers of copper or gold. The slotline is photolithographically defined and etched out to a width of 1 mm. The slot 16 is 7.2 mm long and 0.8 mm wide. This means that the microstrip transmission lie 5 and back electrode 7 are spaced from the slotline electrodes 14 by a gap of about 0.145 mm. There is therefore no electrical connection between the microstrip 8 and slotline 9 circuits. Many slotlines may be formed on a large substrate, particularly when feeding many elements in a phased array.

Figure 5:
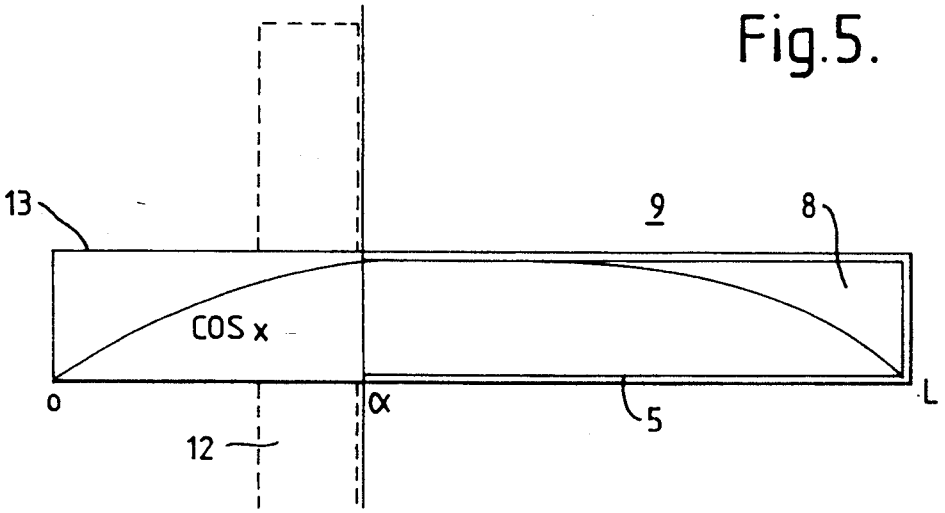
FIG. 5 is a plan view showing the electrical field of the transition.

The coupling of energy between microstrip 8 and slotline 9 is by electromagnetic coupling. As indicated in FIG. 5 microstrip feed transmission line 12 excites the slot 13 in the slotline 9 in a conventional microstrip to slotline transition. The length of the slot 13 is given as L. The electric vector in the slot forms an approximately half cosine pattern. The parallel plate transmission line 5 intercepts a fraction of this field; the position of the line 5 is given as x.

$$\text{Total energy in slot} = \int_{o}^{L} \sin^2(\pi x/L)dx$$

Energy intercepted by the parallel plate transmission line =

$$\int_{a}^{L} \sin^2(\pi x/L)dx$$

i.e. the amount of energy transferred varies with the value (L-u), the width of the parallel plate transmission line 5.

The energy transfer, or transmission, between the microstrip 8 and the slotline 9 is the ratio of these two quantities, assuming an otherwise perfectly match system, i.e.

$$\frac{\text{Energy intercepted by plate}}{\text{Total energy in slot}}$$

Figure 6:
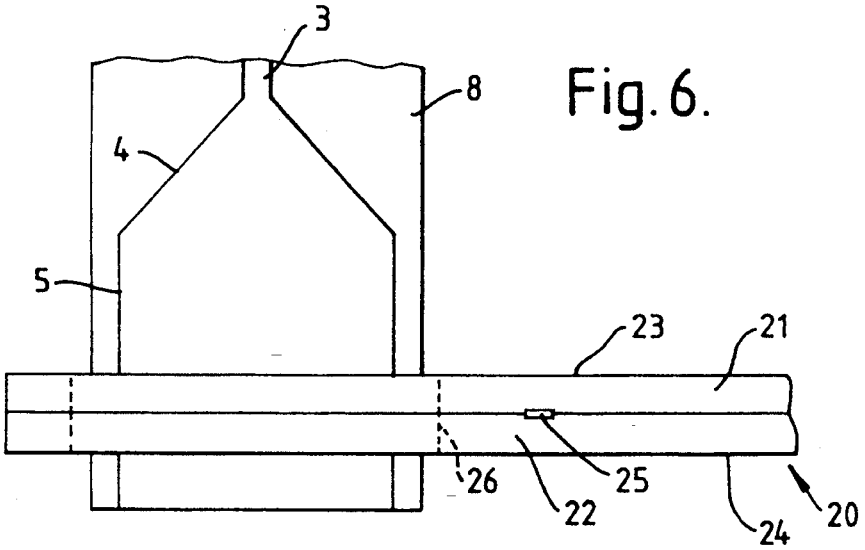
FIG. 6 is a front view of an alternative connector using triplate.

As shown in FIG. 6 the second substrate 10 of FIG. 1 may be replaced by a triplate structure 20 which is effecitvely two slotline substrates 21, 22 and back electrodes 23, 24 glued face to face enclosing a common transmission feed 25. In this configuration a slot 26 is made in both substrates 21, 22 and material removed from both back electrodes 23, 24. The microstrip transmission line 8 passes through both triplate substrates. By selectively covering one of the quarter wavelength slotline short circuits (i.e. covering one of the slots 13 in the electrodes 23 or 24 adjacent to feed 25 by a strip of electrically conducting material), the transition can be made to pass a narrower band of frequencies and will severely attenuate frequencies outside this range.

The connector 1 can be excited by using either microstrip or slotline both having a similar performance.

Microstrip and triplate versions of the connector have been found to perform satisfactorily at frequencies between 800 MHz and 10 GHz.

The following tables give typical results:

TABLE 1

| | |
|---|---|
| Maximum transmission | −1.8 dB |
| Centre frequency | 8.5 GHz |
| 3 dB frequency bandwidth | 1.0 GHz |
| Maximum reflections: | |
| with microstrip 8 as input | −15.0 dB |
| with slotline 9 as input | −10.0 dB |

TABLE 2

| | |
|---|---|
| Characteristic impedances: | |
| of microstrip 8 | 50 ohms |
| of slotline 9 | 100 ohms |
| Substrate thickness: | |
| microstrip 8 | 0.71 mm |
| slotline 9 | 1.26 mm |
| Parallel Plate line width | 5.25 mm |

Figure 7:
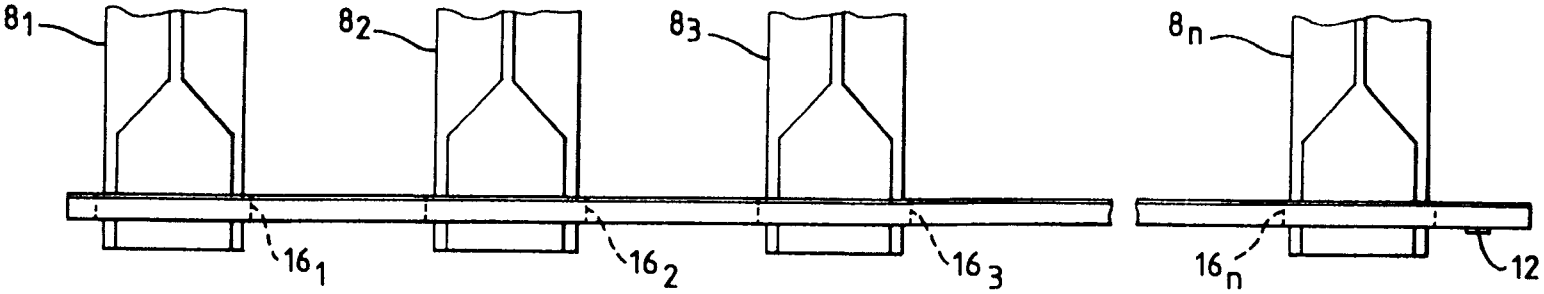
FIG. 7 is a front view of a connector with several connections in one slotline.

In the modification shown in FIG. 7 the second substrate 10 and slotline 13 are extended in length. Within the slot line 13 several slots $16_1$ to $16_n$ are formed, each similar to that of slot 16 in FIG. 1. Microstrip circuits $8_1$, $8_2$ . . . $8_n$ are fitted into these slots $16_1$, $16_2$ . . . $16_n$. Power for the slot line 13 is from a microstrip feed 12 as before. Each microstrip circuit $8_1$ to $8_n$ extracts a proportion of energy from the slot line 13.

The slot line 13 may be straight or curved so that the microstrips $8_1$ to $8_n$ may be in line or staggered. The microstrips $8_1$ to $8_n$ may be similar or be different circuits.

Figure 8:
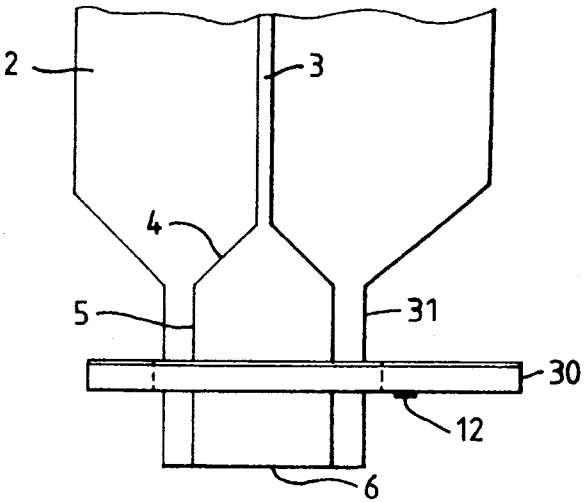
FIGS. 8, 9 10 are front, side, and plan views respectively of a connector holding several microstrip components in a slot line component substrate.
Figure 9:
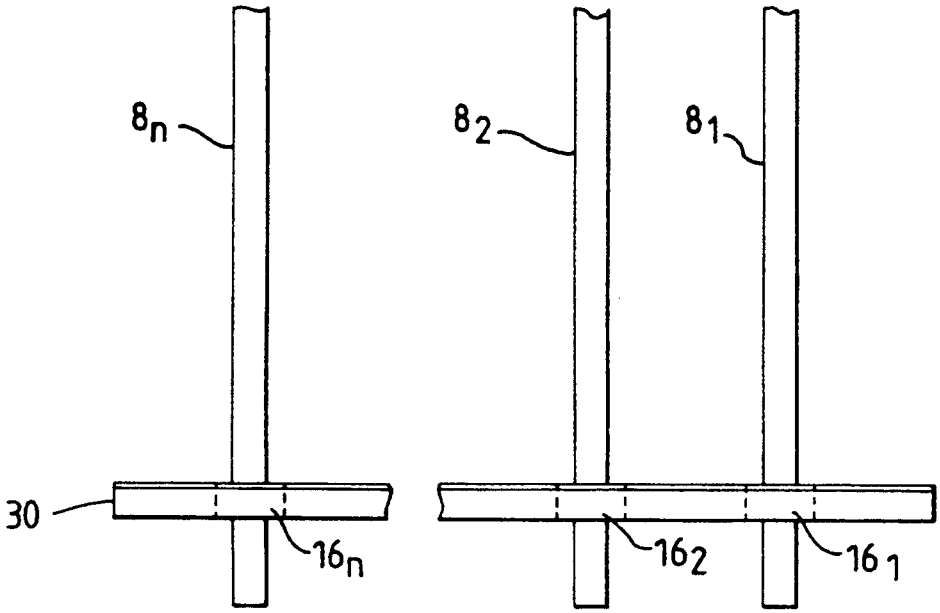
Figure 10:
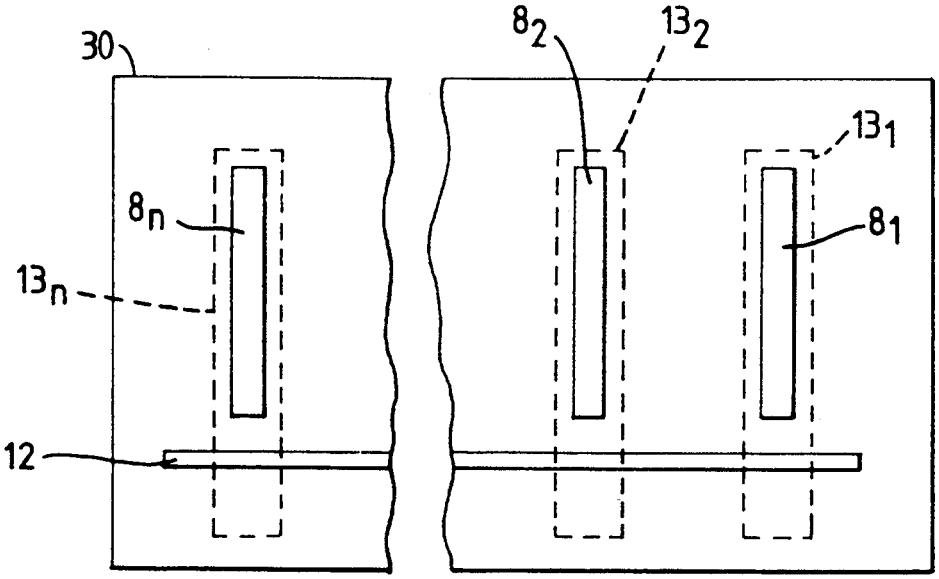

An alternative manner of connecting several circuits together is shown in FIGS. 8, 9, 10. A slot line second substrate 30 carries several microstrip lines $8_1$ to . . . $8_n$. Each microstrip $8_n$ comprises a substrate 2 which has a narrowed end 31. This substrate 2 carries a microstrip component 3 connecting to a quarter wavelength taper section 4 and a pseudo parallel plate transmission line 5 terminating in a wrap round circuit 6 to a rear mounted ground electrode.

The second substrate 30 comprises several slot lines $13_1$, $13_2$ . . . $13_n$ each fed by a common microstrip feed 12. Within each slot line $13_1$ to $13_n$ is a slot $16_1$ to $16_n$ for carrying a microstrip line $8_1$ to $8_n$. The slot liens $13_1$ to $13_n$ may be aligned as shown or staggered as required.

We claim:

1. A microwave connector comprising a first substrate and a second substrate arranged with the first substrate within an aperture in the second substrate at least within 45° of being in orthogonal planes;

the first substrate being a microstrip circuit including a taper second leading from a microstrip component to a pseudo parallel plate transmission line having a length of approximately half wavelength long at center frequency terminating in a short circuit to a ground plane;

the second substrate begin a slotline circuit having a slotline component terminating in a short circuit element, and a slot aperture adjacent the short circuit element of length approximately half the slotline wavelength long sufficient to accommodate the first substrate pseudo parallel plate transmission line and width less than the slotline width;

the arrangement being such that the two substrates are electrically unconnected and that energy transfer occurs between the two substrates due to electromagnetic coupling between the parallel pate transmission line and the slotline.

2. The connector of claim 1 wherein the second substrate has bonded thereto a further substrate with back electrode and common transmission feed forming a triplate configuration.

3. The connector of claim 1 wherein the second substrate has formed thereon a slotline to microstrip element for connecting to further microstrip circuits.

4. The connector of claim 1 wherein the second substrate has a plurality of slot apertures each int he slot line component to carry a pseudo parallel plate transmission line of a microstrip component.

5. The connector of claim 1 wherein the second substrate has formed thereon a plurality of slot lines each having a slot aperture for carrying the substrate of a microstrip circuit.

* * * * *